US008469781B2

(12) United States Patent
Reuther et al.

(10) Patent No.: US 8,469,781 B2
(45) Date of Patent: Jun. 25, 2013

(54) MINE BARRIER SURVIVAL SYSTEM

(75) Inventors: James J. Reuther, Worthington, OH (US); Richard W. Givens, Upper Arlington, OH (US); Frank J. Bis, Dublin, OH (US); James M. Gant, Westerville, OH (US); James T. Worthington, II, Worthington, OH (US)

(73) Assignee: Battelle Memorial Institute, Columbus, OH (US)

( * ) Notice: Subject to any disclaimer, the term of this patent is extended or adjusted under 35 U.S.C. 154(b) by 1232 days.

(21) Appl. No.: 12/302,331

(22) PCT Filed: May 29, 2007

(86) PCT No.: PCT/US2007/012643

§ 371 (c)(1),
(2), (4) Date: Nov. 25, 2008

(87) PCT Pub. No.: WO2007/142917

PCT Pub. Date: Dec. 13, 2007

(65) Prior Publication Data

US 2009/0197518 A1 Aug. 6, 2009

Related U.S. Application Data

(60) Provisional application No. 60/810,454, filed on Jun. 1, 2006.

(51) Int. Cl.
*E21F 1/14* (2006.01)

(52) U.S. Cl.
USPC ..... 454/170; 454/168; 454/169

(58) Field of Classification Search
USPC ..... 454/168, 169, 170, 171, 172; 299/12; 405/132; 169/64, 48, 52; 128/205.26, 205.28, 128/202.26
See application file for complete search history.

(56) References Cited

U.S. PATENT DOCUMENTS

| | | | | | |
|---|---|---|---|---|---|
| 2,758,015 | A | * | 8/1956 | Bovard et al. | 422/120 |
| 4,009,649 | A | * | 3/1977 | Thimons et al. | 454/170 |
| 4,023,372 | A | * | 5/1977 | Presler et al. | 405/132 |

(Continued)

FOREIGN PATENT DOCUMENTS

| | | | |
|---|---|---|---|
| AU | 766344 B | * | 10/2003 |
| FR | 2290228 A | * | 7/1976 |
| GB | 2399003 A | * | 9/2004 |
| WO | WO 0019063 A1 | * | 4/2000 |

OTHER PUBLICATIONS

Stricklin, Kevin; Implementation of Section 2 of the Mine Improvement and New Emergency Response (MINER) Act of 2006: Options for Providing Post-Accident Breathable Air to Underground Coal Miners. Program Information Bulletin No. P07-03; Feb. 8, 2007.

(Continued)

*Primary Examiner* — Steven B McAllister
*Assistant Examiner* — Brittany E Towns
(74) *Attorney, Agent, or Firm* — Klaus H. Wiesmann; Yimei C. Hammond

(57) ABSTRACT

A barrier survival system that isolates a safe volume within a mine or other confined structure and provides breathable air to one or more survivors within the safe volume who are awaiting rescue by generating oxygen, removing one or more toxins, carbon dioxide and carbon monoxide; and providing heat.

14 Claims, 5 Drawing Sheets

U.S. PATENT DOCUMENTS

| | | | | |
|---|---|---|---|---|
| 6,419,324 | B1 * | 7/2002 | Kennedy et al. | 299/12 |
| 7,549,431 | B1 * | 6/2009 | Farnworth et al. | 135/115 |
| 2007/0218825 | A1 * | 9/2007 | Howery | 454/170 |
| 2009/0061267 | A1 | 3/2009 | Monzyk et al. | |

OTHER PUBLICATIONS

Bauer, E.R. and Kohler, J.L.; Update on Refuge Alternatives: Research, Recommendations and Underground Deployment.

Department of Labor, Mine Safety and Health Administration; Refuge Alternatives for Underground Coal Mines; Final Rule; Federal Register/vol. 73, No. 251; Wednesday, Dec. 31, 2008, Rules and Regulations; pp. 80656-80700.

Fasouletos, Michael A.; Parametric Design of a Coal Mine Refuge Chamber; Master of Science Thesis; 2007; College of Engineering and Mineral Resources at West Virginia University.

* cited by examiner

MINE BARRIER SURVIVAL SYSTEM

This application claims the benefit of U.S. Provisional Application No. 60/810,454 filed Jun. 1, 2006, Mine Curtain Survival System, Frank J. Bis et al., inventors.

The entire disclosure of the above referenced provisional application is hereby incorporated by reference.

STATEMENT OF GOVERNMENT RIGHTS

This invention was made with Government support under Contract No. 200-2007-22067 awarded by Centers for Disease Control and Prevention. The Government has certain rights in this invention.

FIELD OF THE INVENTION

The invention relates to the survival and rescue of personnel in mines and other underground facilities as well as in enclosed areas having air quality or toxicity challenges from accidents, such as fires or explosions, or deliberate acts, such as terrorist attacks.

BACKGROUND OF THE INVENTION

The tragic loss of hundreds of lives in underground mine fires in West Virginia, Mexico, and China in late 2005 and 2006 revealed a serious deficiency in terms of emergency response. This is exemplified by the failure to rescue underground miners who survived the initial explosion. This failure resulted primarily because of an underestimation in the time required for rescue.

As recent mine fires dramatically demonstrate, the time needed to complete recovery operations into distant and/or remote mine positions typically is not measured in several hours but rather in several days. Extended time was and will be necessary to get rescue teams on the scene, diagnose the crisis, develop a safe plan of attack, and undertake the rescue.

To mine survivors, awaiting rescue is a life-threatening ordeal. Their most vital immediate need is finding breathable air, if possible. The multiple threats survivors must endure from toxic environments such as post-fire mine environments for up to several days are typically the following:

Exposure to elevated concentrations of carbon monoxide (CO);

Exposure to elevated concentrations of carbon dioxide, ($CO_2$);

Exposure to reduced oxygen concentrations of ($O_2$); and

Exposure to cold, ambient mine temperatures.

Fire poisons local mine air with CO and $CO_2$ and consumes the $O_2$ that is required to sustain life. Depending upon the elevated or reduced levels of these gases, the toxic mine air can cause death by asphyxiation either instantly (within minutes) or slowly (over days). The outcome of the last threat could be death by hypothermia.

Miners are trained to seek a habitable atmosphere in which to barricade and take refuge while awaiting rescue. Because finding breathable air that sustains life may be impossible, there is a technological need for the survivors to create a safe volume having habitable atmospheres with breathable air on demand.

BRIEF DESCRIPTION OF THE INVENTION

A broad embodiment of the invention discloses a kit for providing a safe volume having air breathable by humans including one or more inflatable barriers for providing the safe volume wherein one or more sides of the safe volume are provided by the inflatable barrier; a carbon dioxide absorbent for absorbing carbon dioxide from air within the safe volume; an oxygen generator for providing oxygen within the safe volume; and a catalyst for converting carbon monoxide to carbon dioxide within the safe volume. It may be useful to provide a spray foam container (e.g. spray can) for sealing the periphery of the inflatable barrier and a wall touching the inflatable barrier. Typically another embodiment provides for one or more tabs at the periphery of the inflatable barrier and a stud gun and anchors for anchoring one or more tabs to a wall touching the periphery of the inflatable barrier. Should a person arrive after the barrier has been erected a sealable entry way through the inflatable barrier for admission or exit of a human can be provided.

The kit is typically stowed in the general area where it is to be used in a sealed container that is non-permeable to air or may be permeable thereto.

Another general embodiment according to the invention includes an inflatable barrier including a flexible substantially circular or polygonal donut shaped tube having an open core; a flexible sheet disposed within the core and operationally fixed to the tube for sealing the core; a reactive gas generating apparatus disposed within or adjacent to one portion of the tube, for inflating the tube; and a reactive chemicals and catalysts disposed on one side of or within a semi-permeable membrane to process toxic atmosphere into breathable air. The reactive chemicals and catalyst typically reduce levels of $CO_2$, and CO; and increase oxygen levels, to at least survivable levels for one to several days and in some embodiments up to one week.

A flexible foam layer disposed on a periphery of the inflatable tube is useful for reducing ingress of toxic air.

A particularly useful embodiment of the invention includes the integration of the carbon dioxide absorbent, oxygen generator, and carbon monoxide catalyst wherein waste heat from $CO_2$ absorption and $O_2$ generation can be used to enhance the operation of the catalyst.

DETAILED DESCRIPTION OF THE INVENTION AND BEST MODE

Broadly, the invention provides for survival of personnel awaiting rescue in confined or closed spaces in which the atmosphere outside is not habitable for any significant length of time because of the release of toxic gases and the removal of life-sustaining oxygen as a result of fires or explosions, including underground mines (coal, salt, mineral), submarines, tunnels, and basements.

A first embodiment of the invention includes a kit for providing a safe volume in which there is available breathable air for up to 10 to 15 survivors for up to 4 to 7 days. Breathable air defined as air that allows long term survival if breathed for the duration of the stay in the safe volume.

The first element of this kit is an inflatable barrier with which to rapidly isolate a confined space within which to create a habitable atmosphere with breathable air and await rescue. Deploying a one barrier, two barriers, or only a few barriers to create a safe volume has not been the approach based on information reported in a worldwide review of the state-of-the-art by the Mine Safety and Health Administration, MSHA (*Mine Escape Planning and Emergency Shelters*, Washington, D.C., April, 2006). Of the over 20 "emergency-shelter" technologies assessed, many of which patented, all reported that the deployment of a gas tight 3-dimensional (D) chamber was necessary to create a safe haven within which survivors would await rescue.

This unanimous thinking to deploy a chamber (providing not only the walls but also the roof and floor), instead of creating a safe haven by erecting only a few barriers, appears to be based on the lethality of one toxic gas present, CO.

The prior logic appears to be that a safe haven must be hermetically sealed to deny the infiltration of any CO. The facts are that safe havens do not have to be all encompassing and leak-free to be effective, because low levels (25 parts per million, ppm) can be tolerated for days without adverse health effects.

Relying on a 2-D rather than 3-D deployment configuration greatly improves the pre-positioning, deployment, and re-deployment of the equipment needed to create a safe volume on-demand. Deploying only a few barriers to build a safe volume constitutes one embodiment of this invention.

Figure 1:
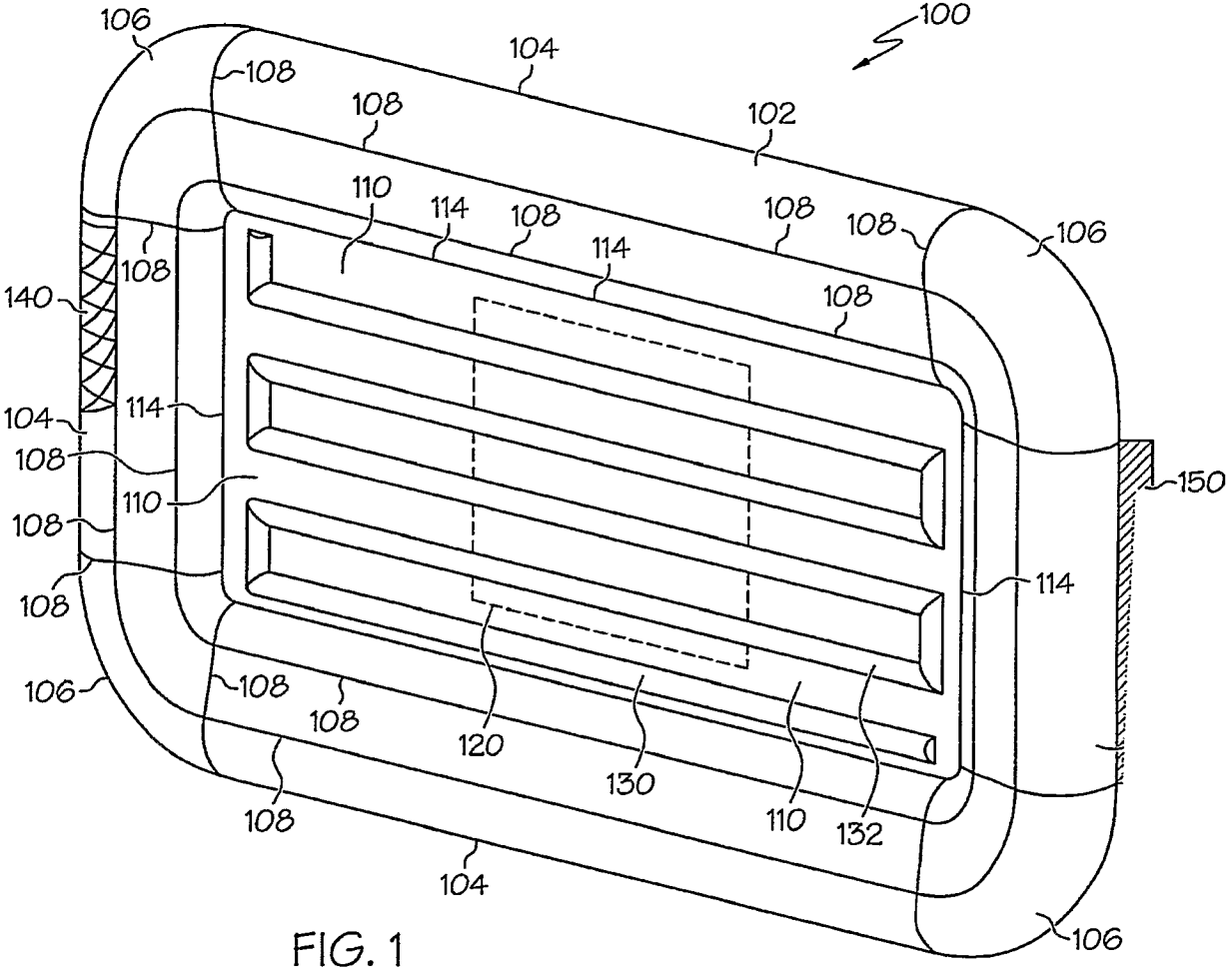
FIG. 1 is a schematic drawing showing one embodiment for a barrier according to the invention. The barrier includes an inflatable seal typically at the periphery of the barrier and optional chemicals embedded for providing breathable air within an enclosure defined by one, two or more barriers.

Referring now to FIG. 1, this figure is a schematic drawing that illustrates a typical inflated barrier according to one aspect of the invention. Barrier 100 of a generally circular, oval, or polygonal shape (view shown is a rectangle with four sides). The outer portion of the barrier 100 is typically a tube shape 102 typically comprising four sides 104 with four corners 106. Seams 108 may be present for ease of construction or strengthening or may be absent. The barrier 100 generally describes a donut shape with the tube 102 providing the outer portion and a typically sheet 110 providing sealing to the center of the donut. The sheet 110 is typically attached to the tube 102 at seam 112. In some embodiments sheet 110 has a sealable door 120 that can be used for ingress and egress of persons. The door 120 may be opened or closed by zippers, Velcro® or similar devices. Additional features of the barrier 100 include chemicals for providing breathable air within a safe volume formed at least in part by the barrier 100. Chemicals 130 are typically positioned within or on the barrier 100 as shown by chemical enclosure 132. Chemical enclosure 132 may be sealed initially within a non-porous material that is ruptured by a draw string or other mechanism and the containing material may be porous. In either case the chemical is positioned to release the chemicals or have the chemicals effects apparent within a safe volume formed by the barrier 100. One or both sides of the barrier may be color coded by bright colors to alert the user as to the proper positioning of the barrier 100. FIG. 1 also shows an inflator 140 used for inflating the barrier 100 that may be manual (by pumping or automatic by an air bag type device or both. The propellant for the air bag device may include sodium azide and the like in a form that provides slower gas release than in a typical air bag for a car since inflation times of several second so several minutes are acceptable. If desired a sealant 150 (e.g. soft foam material such as a foamed polymer having closed cells) may be placed on the outer periphery of the barrier 100 to enhance sealing with a wall (shown in FIG. 2) so that flow of gases into and out of the safe volume can be better controlled. A typical barrier 100 may measure about 1 meter by 1 meter up to about 10 meters by 10 meters. A typical mine shaft my measure 2 meters by 7 meters. Materials useful for the barrier 100 include polymers that are generally nonporous, flexible metal foil (e.g. aluminum), a composite of a thin foil of metal deposited on a polymer, and the like. The sheet 110 may be also made of flexible metallic materials. Typical useful polymers include polypropylene and the like.

Figure 2:
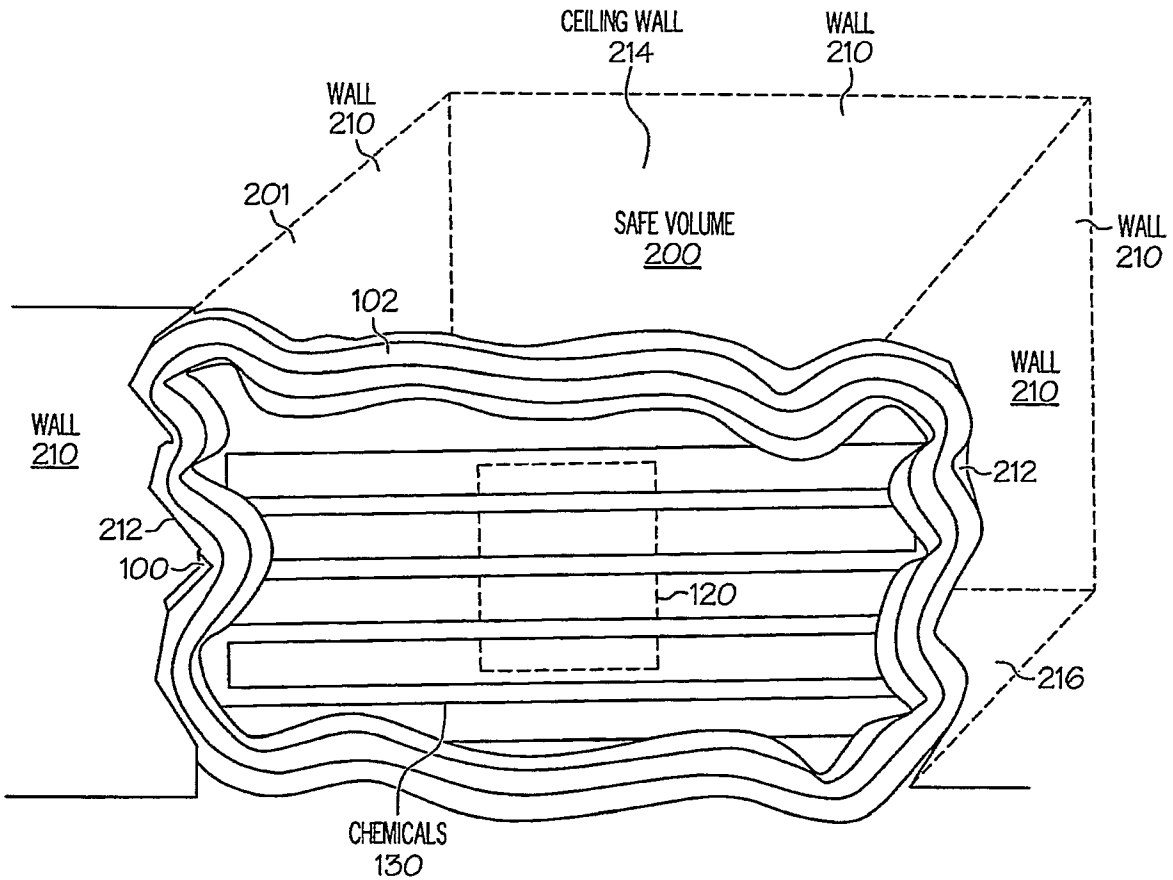
FIG. 2 is a schematic diagram showing an end view of a shaft in a mine or a passageway having irregular sides and sealed with a barrier according to an embodiment of the invention. The passageway dead ends and only one barrier is required.

Referring now to FIG. 2, this figure is a schematic drawing that illustrates a safe volume 200 that requires only one barrier 100. Note that the upper portion of the strata in the mine is not shown so as to better illustrate the invention. This embodiment is obtained by the use of a dead end space 201 that is typically constructed in various sites in a mine so as to be available during an emergency. The invention can be stowed in this space and available and activated as needed. FIG. 2 illustrates the placement of the barrier 100 at a wall 210 that typically has irregular sides 212. In this case the safe volume 200 is formed by three generally vertical walls 210, a ceiling wall 214 and a floor wall 216. The barrier 100 thus forming a sixth wall of the safe volume 200.

Figure 3:
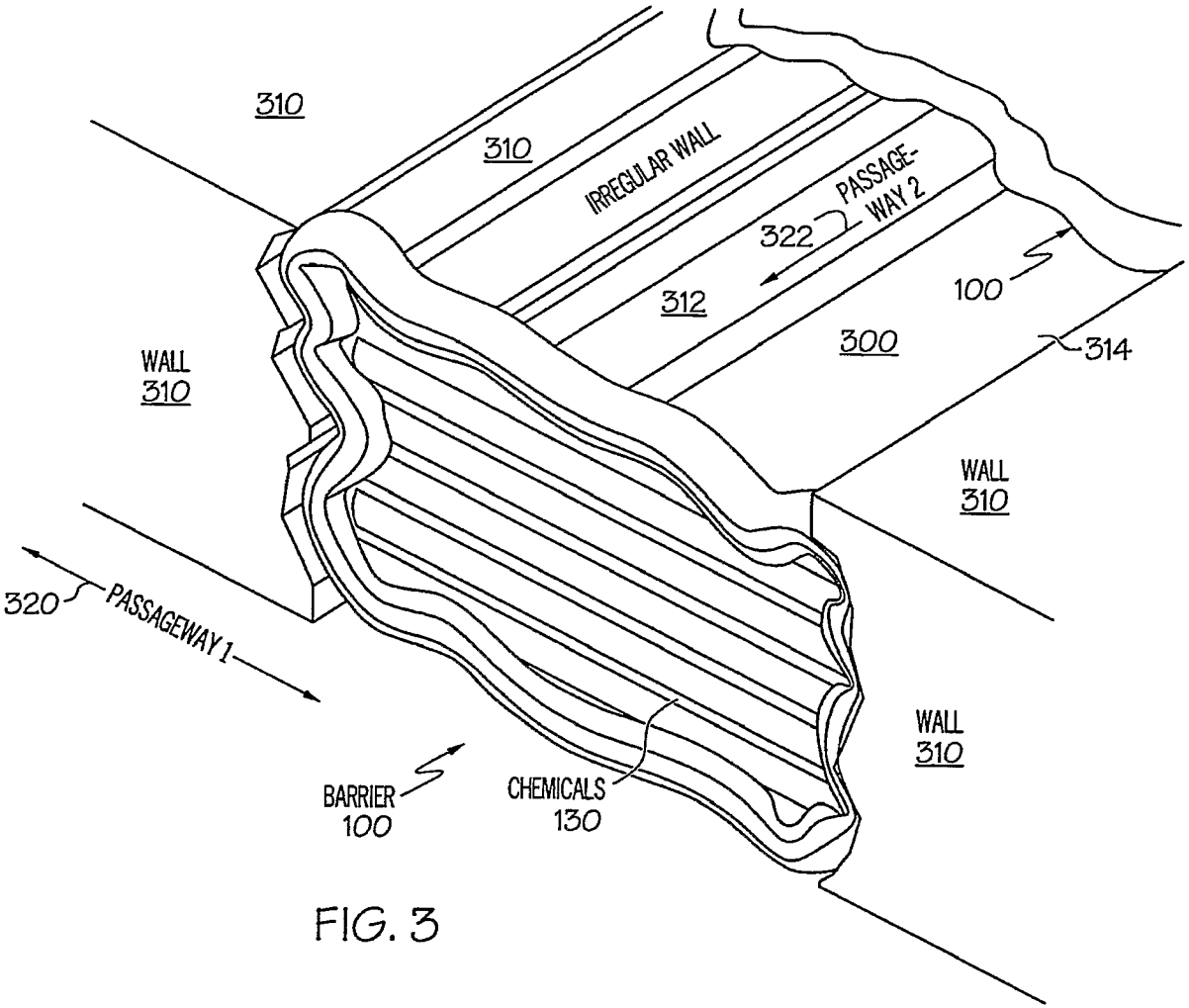
FIG. 3 is a schematic diagram showing an oblique view of a shaft in a mine or a passageway having irregular sides and sealed with a barrier according to an embodiment of the invention where two barriers are used.

Referring now to FIG. 3, this figure is a schematic that shows how two barriers 100 may be used to form a safe volume 300 at the junction of two passageways. One barrier 100 is erected at the walls 310 of one passageway 320 and a second barrier 100 is positioned up the second passageway 322. Again the upper portion of the strata of the mine is not shown to better depict the invention. This embodiment requires two barriers 100 to form the enclosed space and uses two walls 310 of the mine, the floor 312 and ceiling wall 314.

Figure 4:
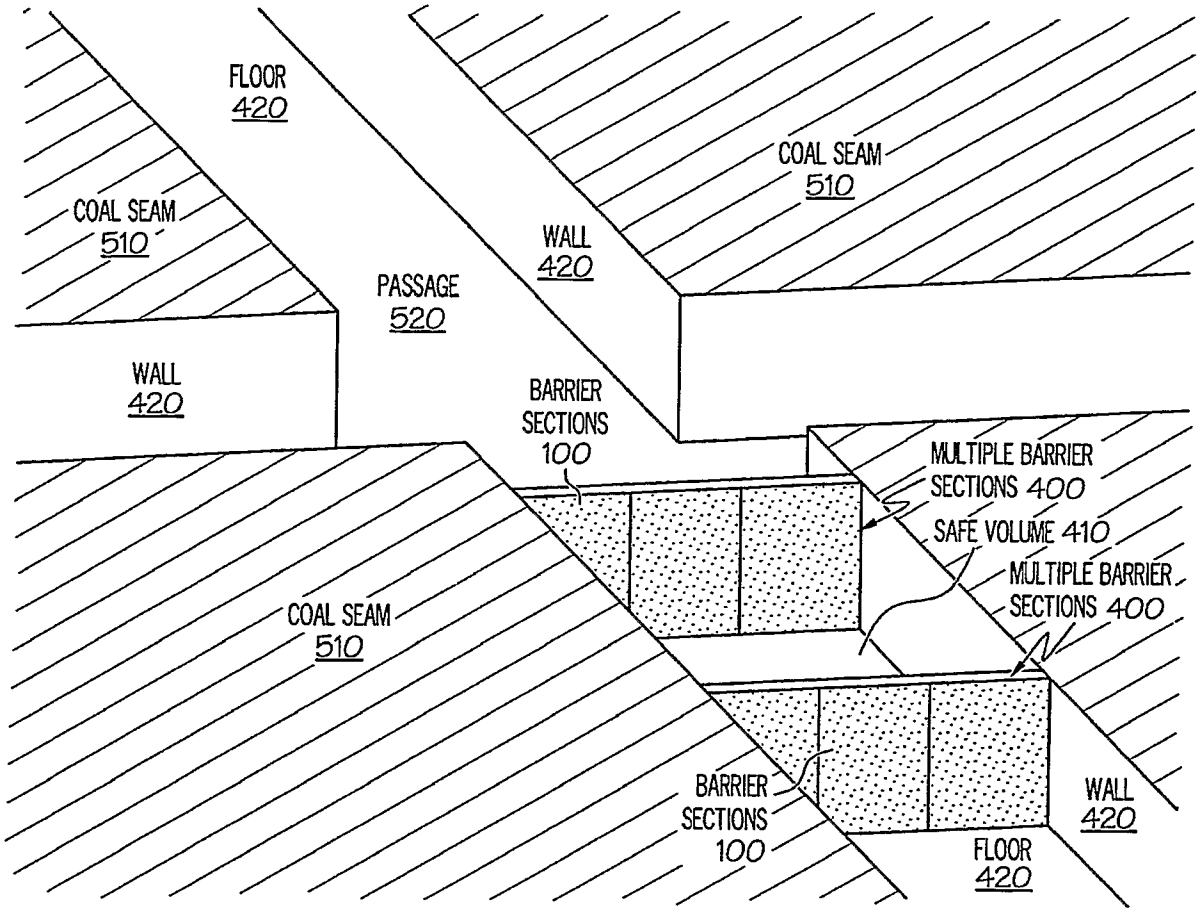
FIG. 4 is a schematic diagram showing an oblique view of a shaft in a mine or a passageway having irregular sides and sealed with a barrier according to another embodiment of the invention, wherein the barrier is according to another embodiment of the invention, wherein the barrier is made up of several connected sections of smaller barriers. In some embodiments each section can function independently of the other sections or they may be function as or be controlled as a unit.

Referring now to FIG. 4, this figure is a schematic that illustrates the use of multiple barriers 100 as sections to form a complete barrier 400. Three barriers 100 are shown to form a new larger barrier 400. Walls 420 of the sides floor and ceiling (not shown for clarity) of the passageway form the remainder of the safe volume 410.

Figure 5:
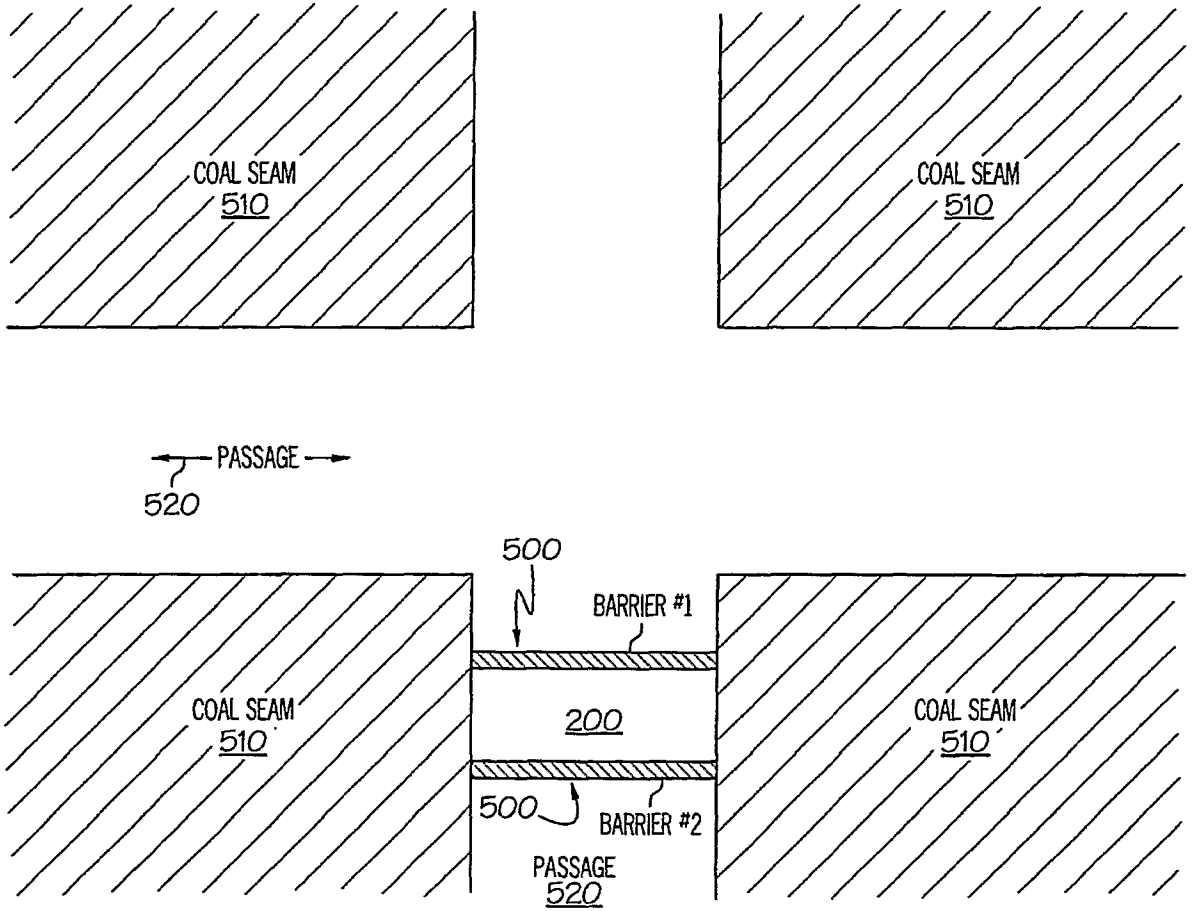
FIG. 5 is a schematic drawing showing a top view of the embodiments according to FIG. 3 or FIG. 4.

Referring now to FIG. 5, this figure shows a top view of a typical barrier system using two barriers of the single (refer to FIG. 3) or multiple type (refer to FIG. 4) in a passageway 520 of a coal seam 510.

A further embodiment of the invention is a kit having a chemical for removing carbon dioxide. The carbon dioxide removal may be according to "Delivery System for Carbon Dioxide Absorption Material", U.S. Pat. No. 6,699,309, Mar. 2, 2004, assigned to Battelle. This technology, known as the "Lithium Hydroxide (LiOH) Curtain" has been deployed by the US Navy for use on-board its submarine fleet. It is designed to be a simple, safe, and reliable to use low-cost technology by which to remove the $CO_2$ exhaled in disable subs, improving a crew's chance to survive while awaiting rescue.

The technology typically consists of polypropylene barriers and LiOH crystals, each storable compactly in maintenance-free metal canisters with long shelf lives. When needed, the ribbed porous barriers are unrolled, loaded with LiOH crystals, and suspended in passageways as curtains. Chemical interaction between the curtain and contaminated air absorbs $CO_2$ and generates heat (up to ~140° F.). By lacing curtains together with tie-wraps/grommets/Velcro along the edges of the fabric, different sizes and configurations of passageways can be barricaded.

As configured, the "sub curtain" addresses only half of the processes needed for extended-miner survival: $CO_2$ removal and heat generation. To counteract the threats of $O_2$-depletion and elevated-CO, two other technologies need to be integrated with the $CO_2$ absorbing curtain, one for $O_2$-generation and the other for CO-removal.

A third embodiment according to the invention may include a kit that comprises a chemical for generating oxygen from chemicals, and not from tanks of compressed gas. One typical $O_2$-generation technique in the embodiment is based on "$O_2$-candle" technology, which uses exothermic reactions between solid chemicals to generate gaseous $O_2$ at atmospheric pressure. Current commercial-of-the-shelf (COTS) $O_2$-candles are off/full-on devices, with no control. In some embodiments of the invention the invention does not include one average micro-(one-millionth) meter particle size of solid chemicals. In other embodiments a "bimodal blend" of micro-meter and nano (one-billionth)-meter sized oxidants (chlorates, perchlorates, and superoxides) and metals (aluminum, and iron, copper or molybdenum oxide) in specific proportions are mixed to release gaseous $O_2$ in a more controlled and extended manner.

A further embodiment according to the invention includes a kit having a catalyst for removing carbon monoxide by converting it to carbon dioxide, which is then removed by absorption. The CO-removal technique is typically any of the low-temperature (100° F.) COTS catalysts available to convert CO to $CO_2$: silver hollandite; platinum/tin oxide; and gold/titanium dioxide.

Incorporating the embodiments for $CO_2$ absorption, $O_2$ generation, and CO reduction into a barrier 100, rather than having them as "stand alone" devices, constitutes another embodiment of this invention. According to details in the aforementioned MSHA review of "emergency shelters" and in MSHA Program Information Bulletin (PIB P07-03, 2007), the obvious practice is to perform each of these processes within the safe volume and not within the barriers that define it. This is obvious practice because the barriers that constitute the walls, floor, and roof of chambers are thin and intended to act only to seal rather than to function as a toxic-atmosphere conditioning device.

Simultaneously conducting $CO_2$ absorption, $O_2$ generation, and CO reduction in an integrated manner, rather than performing them one-at-a-time in separate devices, constitutes another embodiment of this invention. Placing the catalyst for CO conversion to carbon dioxide next to or near the oxygen generation chemical provides heat for the CO conversion process and enhances the reaction rate. According to details in the aforementioned MSHA review of "emergency shelters", the operating characteristics of these processes do not appear to be compatible or synergistic. In particular, it is not obvious why it would be advantageous to use of waste heat from $O_2$ generation or $CO_2$ absorption to enhance a "low-temperature" catalyst for converting CO to $CO_2$. The advantage comes from the fact that the efficiency of even low-temperature catalysts can be improved with rather marginal increases in temperature. The higher the efficiency, the less catalyst needed, thereby lowering weight and cost, or improving speed and efficiency of conversion.

A further embodiment includes another way in which the waste heat generated from $CO_2$-capture and $O_2$-generation, to induce recirculation of the atmosphere within the volume barricaded. According to details in the aforementioned MSHA review of "emergency shelters", battery powered electric fans are required to circulate the atmosphere within chambers to avoid stratification and localized regions within which the level of CO or $CO_2$ is concentrated and more dangerous. In this invention, heat management and flow motivation are achieved by strategically positioning the exothermic toxic-gas cleaning processes at specific horizontal and vertical locations within the barrier, and relying on molecular-weight differences and thermal gradients to induce recirculating flow. This feature allows the non-mechanical, non-electric barrier to achieve the attributes of an electric-fan system, but without the fan or battery.

Another embodiment of the invention involves the reduction of both the levels of $CO_2$ and CO. Not widely known is that the lethality of elevated levels of $CO_2$ and CO individually is not the same as that when these toxic gases are present simultaneously. In particular, the lethality of 5% $CO_2$ AND 2,500 ppm CO is greater than that of 5% $CO_2$ OR 2,500 ppm CO alone. Because of this, MSHA, of expert skills in the prior art, recommended in Program Information Bulletin (PIB P07-03, 2007) that only CO, and not both CO and $CO_2$ levels had to be reduced in safe volumes. The present invention provides that levels of $CO_2$ and CO are both be reduced to take advantage of this life-saving physiological effect.

Other attributes, if incorporated, are expected to enhance the functionality of the barrier:

1) An inflatable-deployment and soft-sealing system, or a means by which to inflate the periphery of the barrier, typically using solid-propellant gas generator (auto air-bag) technology, to temporarily "seal" the barrier against the roof, walls, and/or floor.

2) A hard-sealing system, or a means by which to permanently attach the edges of the barrier to the roof, walls, and perhaps floor using explosive bolts.

3) A passive-sensor system, or a calorimetric means by which to detect the extent to which CO and $CO_2$ have been removed and $O_2$ generated, or when a chemical has been depleted.

To our knowledge, concepts that were not thought needed or possible include the following:

1) The use of 2D barriers rather than 3D chambers to erect safe volumes;

2) The integrated, synergistic use of processes for making air containing toxic gas breathable by humans; and 3) The passive, synergistic use of waste heat to circulate flow within an enclosure.

Currently, the only option available for extending mine-fire survival is the increased use of self-contained self-rescuers (SCSRs), portable (backpack) breathing devices for individual miners. SCSRS, however, have potential drawbacks:

Limited time of use (extensions in only 1-hour increments, not days).

Extensive backlog to meet increased needs of emerging regulations.

Growing concerns regarding reliability during emergency use.

Escalating maintenance, training requirements, and costs.

In short, there is an urgent critical need for a next-generation miner survival system that would be the following:

Compact and mobile to move by a little as one survivor.

Quick to deploy into an extended-time safe-volume.

Flexible to adapt to various mine spaces, geometries, and surfaces.

Functional to remove CO and $CO_2$, and replenish $O_2$.

Capable to moderate temperature.

Scalable to breathing needs to different numbers of miners.

Scalable to breathing needs to different durations.

Stowable safely for years with little/no maintenance.

Compatible with mine safety equipment, training, and practices.

Economical with low capital costs and maintenance costs.

Versatile for complementary use by mine-rescue teams.

These typical attributes describe the invention, proven to be unique based on data from workshops worldwide on emergency mine safe havens. As conceived, the invention typically allows a:

Survival technology moves at the pace of advancing mine faces.

Safe-volume "built-on-demand" by barricading entries, crosscuts, or rooms.

"Standard" barrier to be precut to most-probable mine passage sizes.

Synergistic process by which to remove CO/$CO_2$ and add $O_2$ and heat.

Shelter to be scaled to various numbers of miners and durations.

Supplies that can be stored unattended for up to 10-years.

System and maintenance cost to be minimal.

While the forms of the invention herein disclosed constitute presently preferred embodiments, many others are possible. It is not intended herein to mention all of the possible equivalent forms or ramifications of the invention. It is to be understood that the terms used herein are merely descriptive, rather than limiting, and that various changes may be made without departing from the spirit of the scope of the invention.

We claim:

1. A kit for providing a safe volume having a habitable atmosphere for humans, comprising a. one or more inflatable barriers for providing the safe volume, wherein one or more sides of the safe volume are provided by the inflatable barrier so that the safe volume is substantially impermeable to an outside atmosphere with reduced $O_2$ concentrations; and wherein the safe volume has an initial atmosphere with reduced $O_2$ concentrations;

b. an oxygen generator for providing oxygen within the safe volume;

c. a carbon monoxide catalyst for converting carbon monoxide to carbon dioxide within the safe volume; and d. a carbon dioxide absorbent for absorbing carbon dioxide within the safe volume;

wherein the oxygen generator, carbon monoxide catalyst, and the carbon dioxide absorbent are positioned on the barrier, and wherein oxygen is generated, and $CO_2$ and CO are reduced in an integrated manner to provide the habitable atmosphere for humans in the safe volume.

2. The kit according to claim 1, wherein the kit comprises: a spray foam for sealing the periphery of the inflatable barrier and a wall touching the inflatable barrier.

3. The kit according to claim 1, wherein inflatable barrier comprises:

one or more tabs at the periphery of the inflatable barrier and a stud gun and anchors for anchoring one or more tabs to a wall touching the periphery of the inflatable barrier.

4. The kit according to claim 1, wherein the inflatable barrier comprises:

a sealable entry way through the inflatable barrier for admission or exit of a human.

5. The kit according to claim 1, wherein the kit elements are disposed within a sealed container that is non-permeable to air.

6. The kit according to claim 1, wherein the kit elements are disposed within a sealed container that is permeable to air.

7. An inflatable barrier, comprising:

a. a flexible substantially circular or polygonal donut shaped tube having an open core;

b. a flexible sheet disposed within the core and operationally fixed to the tube for sealing the core;

c. a reactive gas generating apparatus disposed within or adjacent to one portion of the tube, for inflating the tube to form one or more barriers for providing a safe volume; wherein the barrier has an outer side facing an outside atmosphere with reduced $O_2$ levels and an inner side facing the safe volume; and d. reactive chemicals and catalysts disposed on the inner side of the barrier or within a semi-permeable membrane disposed on the inner side of the barrier to process toxic atmosphere with a reduced oxygen level in the safe volume into a habitable atmosphere to humans, wherein a. the oxygen level is increased and the CO and $CO_2$ levels are reduced, all in an integrated manner to substantially survivable levels for humans; and wherein the barrier is substantially impermeable to an outside atmosphere with reduced $O_2$ levels.

8. The inflatable barrier according to claim 1, comprising a flexible foam layer disposed on a periphery of the inflatable barrier.

9. The kit according to claim 1, comprising an integration of the carbon dioxide absorbent, oxygen generator, and carbon monoxide catalyst wherein waste heat from $CO_2$ absorption and $O_2$ generation are used to enhance the operation of the catalyst.

10. The kit according to claim 1, comprising positioning of reactive materials wherein waste heat from $CO_2$ absorption and $O_2$ generation are used to induce recirculation flow within the safe volume without the use of battery-powered fans.

11. The kit according to claim 1, comprising materials for reducing both $CO_2$ and CO in the atmosphere.

12. The kit according to claim 1, wherein the catalyst for CO conversion to carbon dioxide is placed next to or near the oxygen generation chemical which provides heat for the CO conversion process and enhances the reaction rate.

13. The kit according to claim 1, wherein the kit is capable of moderating temperature through the addition of waste heat from $O_2$ generation and $CO_2$ absorption.

14. The kit according to claim 1, wherein the kit is used in a low temperature environment comprising underground mines, submarines, tunnels, basements, and other similar situations.

* * * * *

UNITED STATES PATENT AND TRADEMARK OFFICE

CERTIFICATE OF CORRECTION

PATENT NO. : 8,469,781 B2
APPLICATION NO. : 12/302331
DATED : June 25, 2013
INVENTOR(S) : Reuther et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1233 days.

Signed and Sealed this
Eighth Day of September, 2015

Michelle K. Lee

Michelle K. Lee
*Director of the United States Patent and Trademark Office*